US010781829B2

(12) United States Patent
Müller et al.

(10) Patent No.: US 10,781,829 B2
(45) Date of Patent: Sep. 22, 2020

(54) FLOW-CONDUCTING GRILLE FOR ARRANGING ON A FAN

(71) Applicant: ebm-papst Mulfingen GmbH & Co. KG, Mulfingen (DE)

(72) Inventors: Jens Müller, Künzelsau (DE); Daniel Gebert, Öhringen (DE); Oliver Haaf, Künzelsau (DE); Josef Rathgeb, Jagstzell (DE); Manuel Vogel, Jagsthausen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 157 days.

(21) Appl. No.: 15/886,949

(22) Filed: Feb. 2, 2018

(65) Prior Publication Data

US 2018/0156240 A1 Jun. 7, 2018

Related U.S. Application Data

(63) Continuation of application No. PCT/EP2016/068610, filed on Aug. 4, 2016.

(30) Foreign Application Priority Data

Sep. 10, 2015 (DE) ..... 10 2015 115 308

(51) Int. Cl.

| | |
|---|---|
| ***F04D 29/70*** | (2006.01) |
| ***F04D 29/54*** | (2006.01) |
| ***F04D 29/42*** | (2006.01) |
| ***F04D 29/44*** | (2006.01) |
| ***F04D 25/08*** | (2006.01) |

(52) U.S. Cl.
CPC ..... *F04D 29/703* (2013.01); *F04D 29/4213* (2013.01); *F04D 29/4233* (2013.01); *F04D 29/44* (2013.01); *F04D 29/544* (2013.01); *F04D 25/08* (2013.01)

(58) Field of Classification Search
USPC ..... 454/275
See application file for complete search history.

(56) References Cited

U.S. PATENT DOCUMENTS 2,305,136 A 12/1942 Campbell
5,466,120 A * 11/1995 Takeuchi ..... F04D 29/703 415/119

(Continued)

FOREIGN PATENT DOCUMENTS

| | | |
|---|---|---|
| DE | 20 2014 105 2 | 1/2015 |
| EP | 1347245 | 9/2003 |
| EP | 2778432 | 9/2014 |

*Primary Examiner* — Woody A Lee, Jr.
*Assistant Examiner* — Jason G Davis
(74) *Attorney, Agent, or Firm* — Harness, Dickey & Pierce, P.L.C.

(57) ABSTRACT

The disclosure relates to a flow-conducting grille for arranging on the suction side of a fan, with a grille web structure which comprises radial webs spaced apart in the circumferential direction and coaxial circumferential webs spaced apart in the radial direction, wherein the radial webs of at least one quadrant of the flow-conducting grille are curved in each case over their radial extension, viewed in the circumferential direction, towards a predetermined radial plane extending from a central axis of the flow conducting grille.

10 Claims, 5 Drawing Sheets

(56) References Cited

U.S. PATENT DOCUMENTS

| | | | | |
|---|---|---|---|---|
| 6,454,537 | B1 * | 9/2002 | Perella | F04D 29/703 416/247 R |
| 7,172,387 | B2 * | 2/2007 | Yamamoto | F04D 29/703 415/119 |
| 2007/0253806 | A1 | 11/2007 | Russell | |
| 2009/0110542 | A1 * | 4/2009 | Kim | F04D 29/703 415/121.2 |

* cited by examiner

FLOW-CONDUCTING GRILLE FOR ARRANGING ON A FAN

CROSS-REFERENCE TO RELATED APPLICATIONS

This application is a continuation of International Application No. PCT/EP2016/068610, filed Aug. 4, 2016, which claims priority to German Application No. 102015115308.4, filed Sep. 10, 2015. The disclosures of the above applications are incorporating herein by reference.

FIELD

The disclosure relates to a flow-conducting grille arranged on the suction side of a fan, with a grille web structure that comprises radial webs spaced apart in the circumferential direction and coaxial circumferential webs spaced apart in the radial direction.

BACKGROUND

From the prior art, for example, from Patent Application EP 2 778 432 A1, flow-conducting grilles are known.

As a result of continuous further development, fans are increasingly quieter in operation. The noise level in the meantime has become so low that rotation-associated tones stand out more clearly. Rotation-associated tones are narrow-band tonal sound components also referred to as propeller noise. Rotation-associated tones occur particularly in asymmetric suction situations, for example, that exist with varying closeness of apparatus walls on the suction side. In such a case, strong air vortexes form, which combine at the narrowest places causing so-called boundary vortexes and directly strike the rotating impeller blades.

The known flow-conducting grilles have a grille structure with radially outward extending radial webs and circumferential webs with constant inclination. In some installation situations, this design is not optimal with regard to the rotation-associated tones generated.

On this backdrop, the underlying aim of the disclosure is to provide a flow-conducting grille that reduces rotation-associated tones in fans, in particular, fans where the air feed flow occurs from the radial direction.

SUMMARY

According to the disclosure, a flow-conducting grille is proposed arranged on the suction side of a fan with a grille web structure that comprises radial webs spaced apart in the circumferential direction and coaxial circumferential webs spaced apart in the radial direction. The radial webs of at least one quadrant of the flow-conducting grille are here curved in each case over their radial extension, viewed in the circumferential direction, towards a predetermined radial plane extending from the central axis of the flow-conducting grille.

The radial plane towards which the radial webs curve in the circumferential direction is oriented or installed here in such a manner that it points in a main feed flow direction of the suctioned air. It is, therefore, also defined as a zero degree radial plane delimiting a first quadrant.

The curvature of the radial webs and in particular their respective curved radial end provide an inflow situation that changes the flow, reducing rotation-associated tones of the downstream fan. Due to the special geometry, the feed flow is not constant viewed over the circumference and not directed to the axial midpoint of the flow-conducting grille.

In an advantageous embodiment variant, the radial webs of two adjacent quadrants of the flow-conducting grille are each curved over their radial extension, viewed in the circumferential direction, towards the predetermined radial plane. In particular, this involves the two adjacent quadrants of the flow-conducting grille, which point in the main feed flow direction of the suctioned air.

In another advantageous embodiment variant, the radial webs of all four quadrants of the flow-conducting grille are each curved over their radial extension, viewed in the circumferential direction, towards the predetermined radial plane. This is particularly advantageous if, due to the installation, there is only one radial main feed flow direction which is then established in such a manner that it extends along the extension of the zero degree radial plane.

The radial webs are curved in the shape of an arc in the circumferential direction. The angle of curvature over their radial extension is variable. In an area close to the central axis of the flow-conducting grille, the curvature of the radial webs is preferably smaller than in their respective radial end.

The radial webs, at the respective radial ends determine an angle $\alpha$. The angle $\alpha$ is formed by a line extending in each case from a central axis of the flow-conducting grille to the respective radial end of the respective radial web and an imaginary curvature-free prolongation of the respective radial web projecting beyond their respective radial end. According to the disclosure, the angle $\alpha$ varies with different radial webs. This means that the radial webs have a different curvature at their respective radial end and are adapted in each case with regard to their shape as a function of the feed flow direction.

The adaptation of the curvature of the individual radial webs occurs in the circumferential direction. Starting from the zero degree radial plane in the circumferential direction, an angle $\rho$ is determined. The zero degree radial plane, here, extends preferably in the main feed flow direction. The radial webs, arranged in each case spaced apart in the circumferential direction by a predetermined angle $\rho$, at their radial ends, determine the angle $\alpha$ which varies depending on the angle $\rho$ with the function:

$$\alpha(\rho)=r1*\rho \text{ for } 0°\leq\rho\leq45°,$$

$$\alpha(\rho)=90*r1-r1\rho \text{ for } 45°<\rho\leq90°,$$

$$\alpha(\rho)=-90*r1+r1\rho \text{ for } 90°<\rho\leq135°,$$

$$\alpha(\rho)=180*r1-r1\rho \text{ for } 135°<\rho\leq180°,$$

where r1 is in a range from 0.6 to 1.2, or preferably in a range from 0.8 to 1.0.

Viewed in the circumferential direction over two quadrants ($\rho$=0-180°), this leads to a different curvature shape of the individual radial webs towards the zero degree radial plane pointing in the main feed flow direction with, in each case, first an increasing curvature and subsequently again a decreasing curvature in the first quadrant ($\rho$=0-90°) and the second quadrant ($\rho$=90-180°).

In a development of the disclosure, the circumferential webs have a defined shape. In an advantageous embodiment, the circumferential webs are designed to have a convex shape along their radial extension and to point at least partially in the direction of the central axis of the flow-conducting grille. The axial extension is here defined as the extension along the central axis of the flow-conducting grille.

In the flow-conducting grille according to the disclosure, in a development, at least one of the circumferential webs has an average axial extension that extends inclined by an angle β with respect to the central axis of the flow-conducting grille. The average axial extension is formed from an axial starting point and an axial end point of the respective circumferential web. Thus, this takes into consideration a possible convex shape of the circumferential webs.

In a design variant which has an advantageous effect on reducing rotation-associated tones, in at least one circumferential web, preferably in all the circumferential webs, the inclination angle β changes over the course in the circumferential direction. This leads to a further adaptation of the geometry of the flow-conducting grille as a function of the feed flow direction, as already occurs due to the radial webs.

The changing inclination angle β of the circumferential webs is determined according to the formula $\beta=a+b*\cos(\rho)$; (a) corresponds to the average value of the angle β over the circumference of the respective circumferential web; (b) corresponds to an established variation value; and (ρ) corresponds to the angle in the circumferential direction starting from the zero degree radial plane.

Depending on the number of the radial main feed flow directions, the flow-conducting grille is adapted in terms of the radial and circumferential webs to produce an at least partially symmetric or asymmetric geometry. In the case of only one main feed flow direction, the respective two mutually adjoining quadrants of the flow-conducting grille are designed to be mirror symmetric with respect to the zero degree radial plane. In other words, the two quadrants that the main flow strikes have the same mirrored shape. The two quadrants facing away from the main flow, however, are designed differently with regard to their radial webs and circumferential webs, so that overall the flow-conducting grille has an asymmetric shape.

In the case of two radially opposite main feed flow directions, in each case two mutually adjoining quadrants of the flow-conducting grille are designed to be mirror symmetric with respect to the radial plane that extends perpendicular to the zero degree radial plane. This means that the two quadrants struck by the flow are mirror symmetric with respect to one another.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a top plan view onto a flow-conducting grille.

FIG. 2*a* is a lateral sectional view A-A of the flow-conducting grille of FIG. 1.

FIG. 2*b* is a lateral sectional view B-B of the flow-conducting grille of FIG. 1.

DETAILED DESCRIPTION

Figure 1:
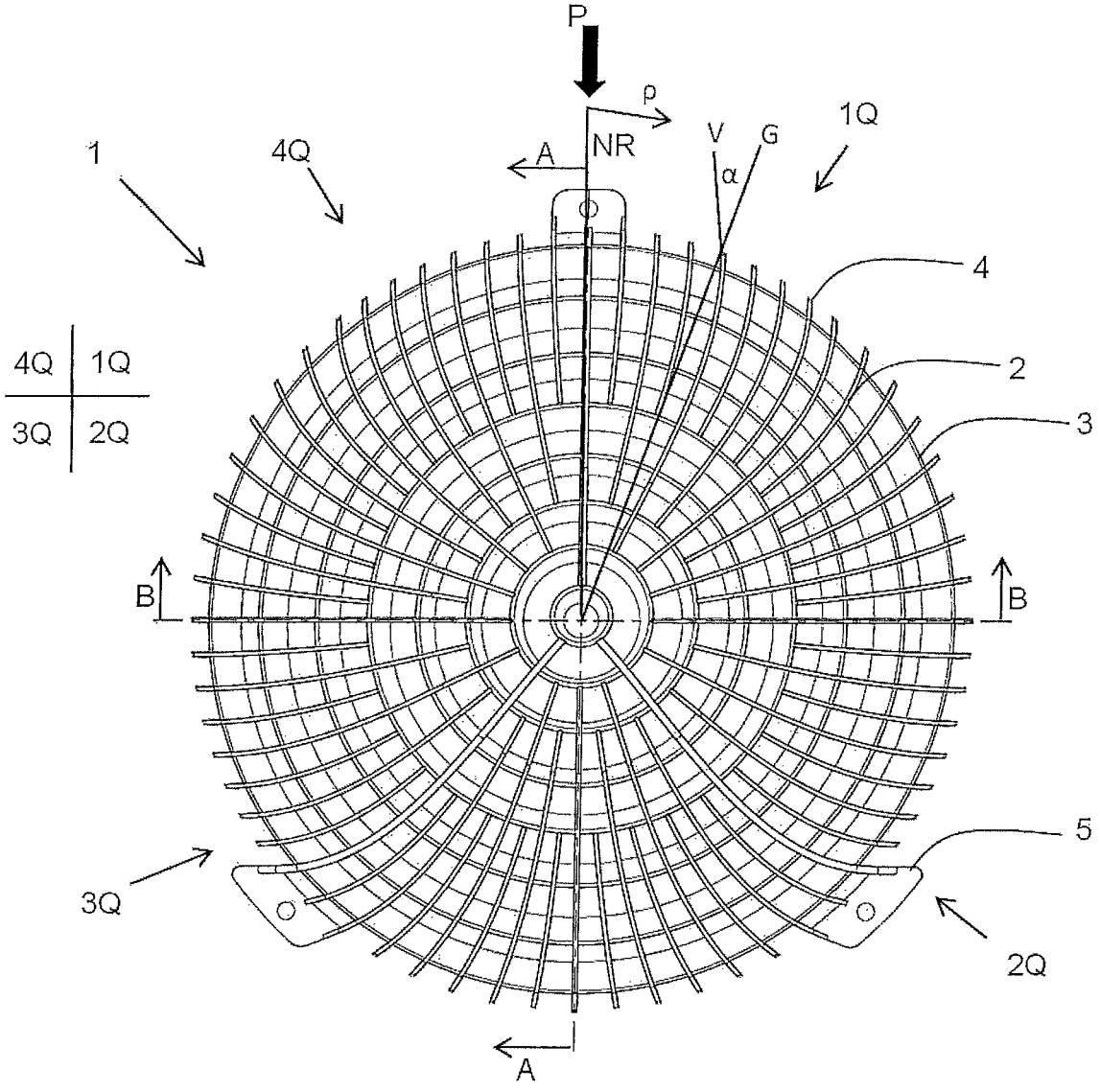

In FIGS. 1-2, an embodiment example of a flow-conducting grille 1 according to the disclosure with a main feed flow direction is represented in different views. Identical reference numerals designate identical parts in all the views.

FIG. 1 is a top view of the flow-conducting grille 1 with a grille web structure. It is designed to be arranged on the suction side of a fan. Three tabs 5 are provided on the radial outer edge for fastening to the fan. The grid web structure is formed by radial webs 2 and coaxial circumferential webs 3. The radial webs 2 are spaced apart in the circumferential direction. The coaxial circumferential webs 3 are spaced apart in the radial direction. The radial webs 2 have different lengths and extend from their radial edge 4 over different distances in the direction of the central axis of the flow-conducting grille 1 in each case up to a circumferential web 3. This leads to the mesh width being smaller in the radial outer area than in the center area around the central axis.

The main feed flow direction is represented by the arrow P and extends along the zero degree radial plane NR that extends radially outward from the central axis. The flow-conducting grille 1 has a geometry that is optimized for this main feed flow direction. For this purpose, the radial webs 2 and the circumferential webs 3 are adapted in four quadrants (1Q-4Q) with regard to their shape and extension. In the first and fourth quadrants 1Q, 4Q, and in the second and third quadrants 2Q, 3Q, the flow-conducting grille is mutually mirror symmetric. The radial webs 2 of the flow-conducting grille 1 are curved in all four quadrants (1Q-4Q), in each case over their radial extension viewed in the circumferential direction, towards the zero degree radial plane NR. The arc-shaped curvature of the individual radial webs 2 varies as a function of their position in the circumferential direction (angle ρ) within the individual quadrants. Within a quadrant, viewed in the circumferential direction, the curvature first increases and subsequently decreases again. The individual radial webs 2, at their radial ends 4, in each case determine a varying angle α, where a is formed at each radial web 2 in each case by the line G, extending from the central axis of the flow-conducting grille 1 to the respective radial end 4 of the respective radial web 2, and by the imaginary curvature-free extension V of the respective radial web 2 projecting beyond the respective radial end 4.

In the design shown, the curvature, i.e., the angle α at the respective radial end 4 of the radial webs 2 is determined as a function of the position in the circumferential direction (angle ρ) in the quadrants 1Q and 2Q by the function $$\alpha(\rho)=0.89*p \text{ for } 0°\leq\rho\leq45°,\ \alpha(\rho)=90*0.89-0.89\rho \text{ for } 45°<\rho\leq90°,$$

$$\alpha(\rho)=-90*0.89+0.89\rho \text{ for } 90°<\rho\leq135°, \text{ and}$$

$$\alpha(\rho)=180*0.89-0.89\rho \text{ for } 135°<\rho\leq180°.$$

Figure 3:
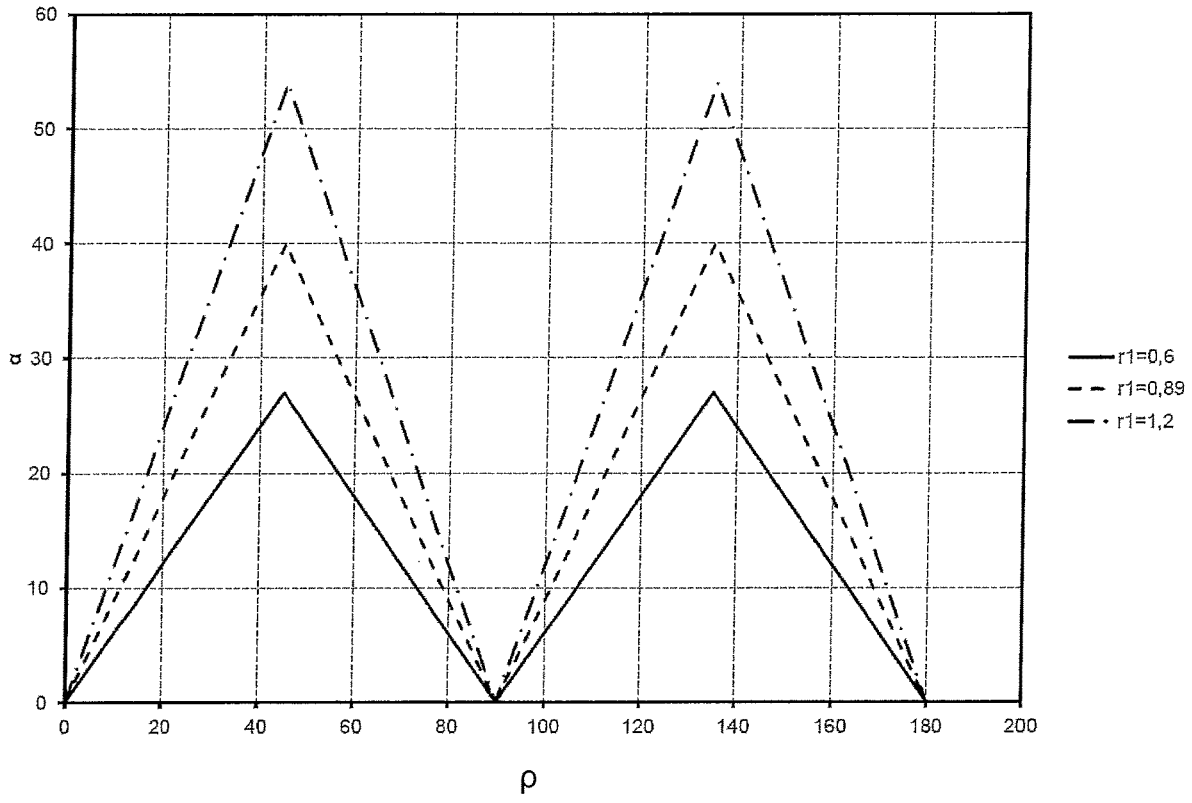
FIG. 3 is a diagram with representation of the development of the angle α of the individual radial webs in the circumferential direction.

The corresponding curve is shown as a broken line in the diagrammatic representation in FIG. 3. FIG. 3 moreover shows a corridor with upper and lower limit curves for the above-mentioned values of r1=0.6 and r1=1.2. Due to the symmetric design of the flow-conducting grille 1, the curves apply correspondingly to the quadrants 3Q and 4Q.

Figure 2A:
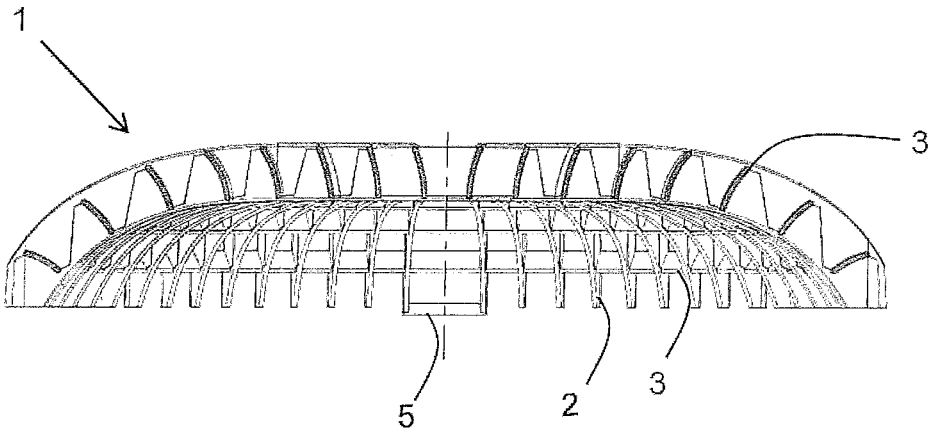
Figure 2B:
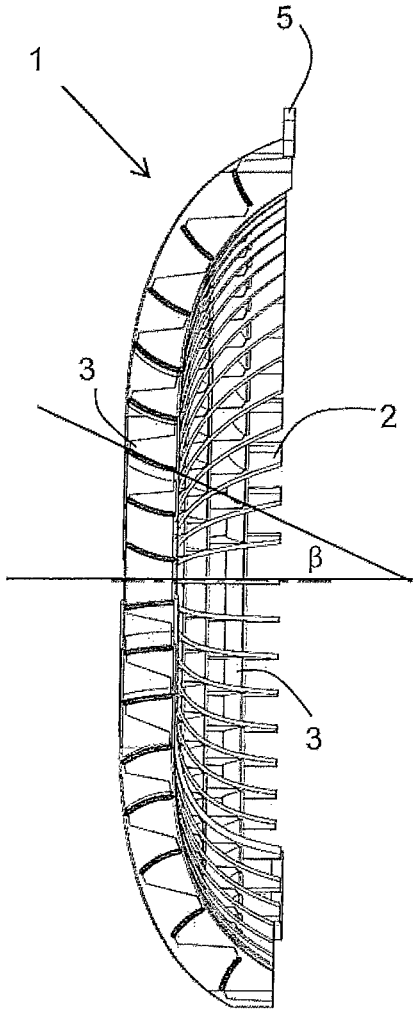

The coaxial circumferential webs 3 are designed to be convex along their axial extension and to point in the direction of the central axis of the flow-conducting grille 1, as can be seen well in the lateral sectional views A-A and B-B according to FIGS. 2*a* and 2*b*. In addition, the inclination of the circumferential webs 3 with respect to the central axis of the flow-conducting grille 1 changes over their course in the circumferential direction. The inclination for a circumferential web 3 at the intersection is sketched as angle β according to FIG. 2*b*. The radially farther outward circumferential webs 3 are more inclined than the circumferential webs extending close to the central axis. Since the inclination varies by the angle β in the circumferential direction, it is determined according to the formula $\beta=a+b*\cos(\rho)$; (a) corresponds to the average value of the angle β over the circumference of the respective circumferential web 3; (b) corresponds to the predetermined variation value; and (ρ) corresponds to the angle in the circumferential direction starting from the zero degree radial plane (NR).

Figure 4:
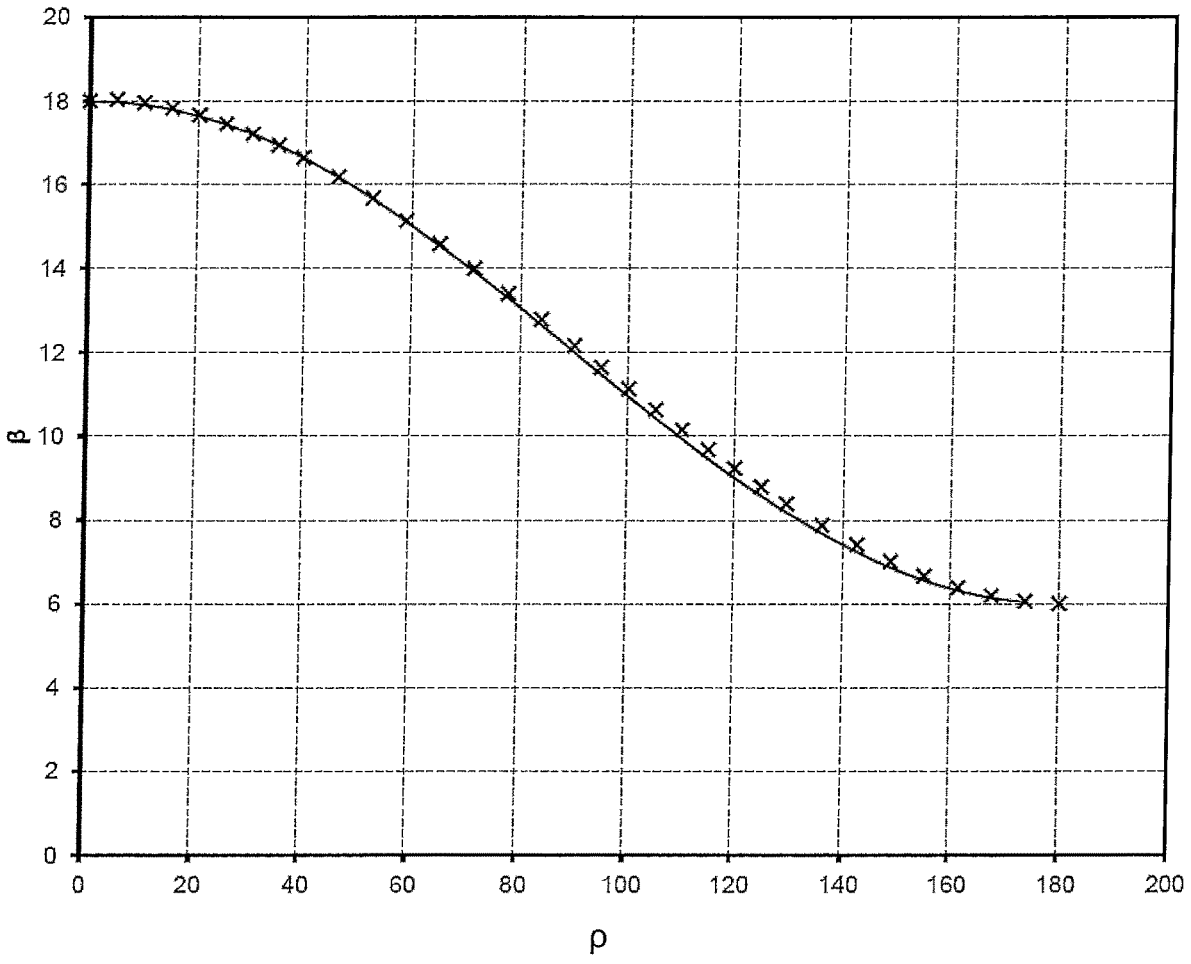
FIG. 4 is a diagram with representation of the development of the inclination angle β of the individual circumferential webs in the circumferential direction.

FIG. 4 shows, as an example, the course of the inclination of a circumferential web 3 and the change in the angle β in the circumferential direction from 0-180°, within the quadrants 1Q and 2Q. In the view shown, the circumferential web 3 has an average value (a) of the inclination of 12°, is considered. This average value is 18° along the zero degree radial plane NR and decreases to 6°. The value (b) is approximately 6.

Figure 5:
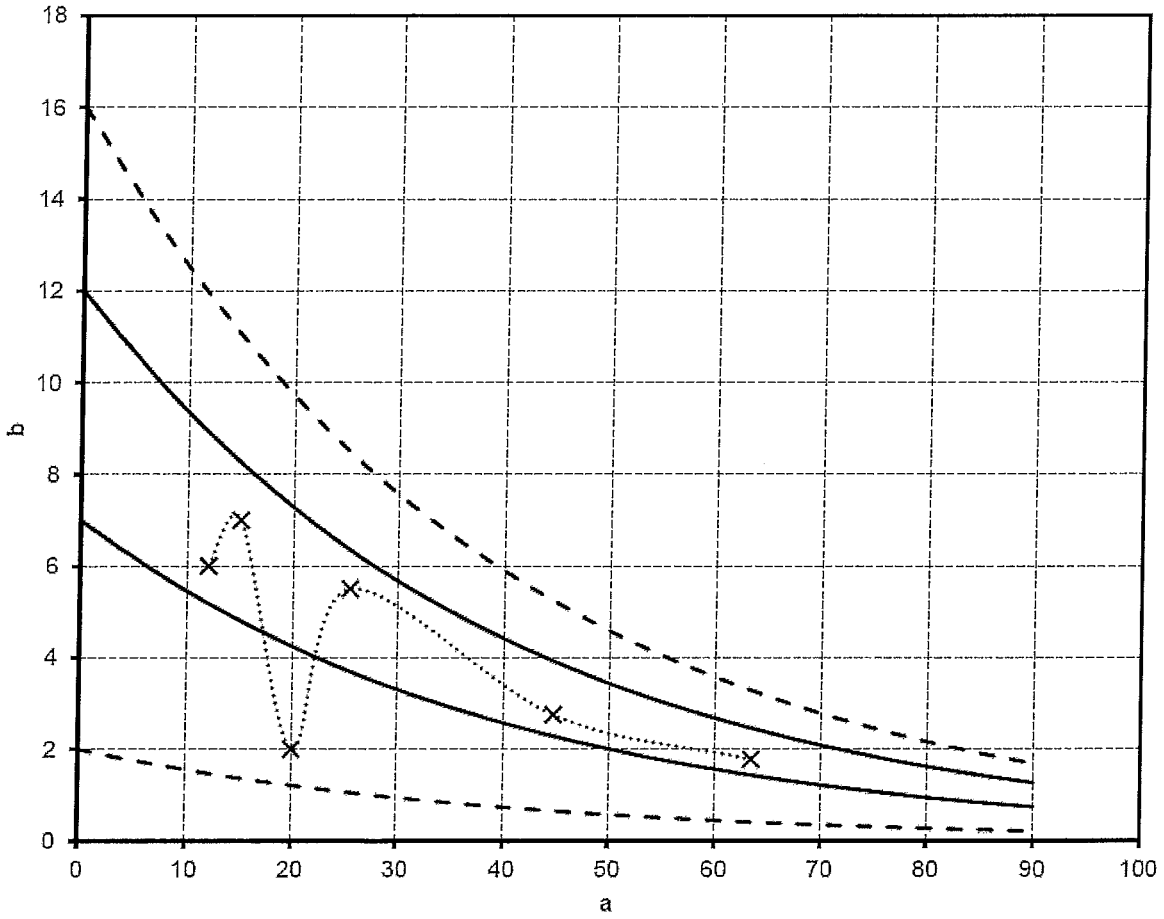
FIG. 5 is a diagram with preferred corridor of the values of the average of the angle β over the circumference and the variation value b.

A preferred range for variation values (b) of the individual circumferential webs 3, that are characterized by their average values (a), is reproduced in FIG. 5.

The higher the average value (a), the farther radially outward from the central axis the respective circumferential web 3 is located. In the case of small average values of (a), the variation values (b) are in the range of approximately 6-9. In the case of large average values of (a), they are in the range of 1.8-3. The broken lines indicate the total range, and the solid lines indicate the preferred range of the variation value b as a function of the average value of the angle β over the circumference. The dotted line connects the values of the circumferential webs 3 of the flow-conducting grille 1 from FIG. 1, which are marked by crosses.

The design is not limited to the above-indicated preferred embodiment examples. Instead, numerous variants are conceivable, that make use of the solution represented, even in designs of fundamentally different type. For example, the flow-conducting grille can be used in axial fans, radial fans and diagonal fans.

What is claimed is:

1. A flow-conducting grille arranged on a suction side of a fan, including a grille web structure comprises:

radial webs, spaced apart in the circumferential direction, and coaxial circumferential webs, spaced apart in the radial direction, the radial webs of at least one quadrant of the flow-conducting grille are curved in each case over their radial extension, viewed in the circumferential direction, towards a predetermined radial plane extending from a central axis of the flow conducting grille;

the predetermined radial plane is a zero degree radial plane (NR) delimiting a first quadrant (1Q);

the radial webs each have radial ends and determine an angle (α) formed by a line (G), extending in each case from a central axis of the flow-conducting grille to the respective radial end of the respective radial web and by an imaginary curvature-free prolongation (V) of the respective radial web projecting beyond the respective radial end, the angle (α) varies with different radial webs; and starting from the zero degree radial plane (NR) in the circumferential direction, an angle ρ is determined, the radial webs, in each case respective, are spaced apart in the circumferential direction by a predetermined angle ρ, radial ends, determine the angle α which varies depending on the angle ρ with the function:

$$\alpha(\rho)=r1*\rho \text{ for } 0°\leq\rho\leq45°,$$

$$\alpha(\rho)=90*r1-r1\rho \text{ for } 45°<\rho\leq90°,$$

$$\alpha(\rho)=-90*r1+r1\rho \text{ for } 90°<\rho\leq135°,$$

$$\alpha(\rho)=180*r1-r1\rho \text{ for } 135°<\rho\leq180°,$$

where r1 is in the range from 0.6 to 1.2.

2. The flow-conducting grille according to claim 1, wherein the radial webs of two adjacent quadrants of the flow-conducting grille are curved over their radial extension, viewed in the circumferential direction, towards the predetermined radial plane.

3. The flow-conducting grille according to claim 1, wherein the radial webs of all four quadrants of the flow-conducting grille are curved over their respective radial extension, viewed in the circumferential direction, towards the predetermined radial plane.

4. The flow-conducting grille according to claim 1, wherein the circumferential webs are designed to be convex along their axial extension and to point at least partially in the direction of the central axis of the flow-conducting grille.

5. The flow-conducting grille according to claim 1, wherein r1 is in a range from 0.8 to 1.0.

6. The flow-conducting grille according to claim 1, wherein at least one of the circumferential webs has an average axial extension extending inclined with respect to the central axis of the flow-conducting grille by an angle β.

7. The flow-conducting grille according to claim 6, wherein in the at least one circumferential web, the inclination angle β changes over its course in the circumferential direction.

8. The flow-conducting grille according to claim 6, wherein all the circumferential webs have an inclination in the angle β.

9. The flow-conducting grille according to claim 1, wherein in each case two mutually adjoining quadrants (1Q; 4Q) of the flow-conducting grille are designed to be mirror symmetric with respect to the zero degree radial plane (NR), and the flow-conducting grille has an asymmetric shape.

10. The flow-conducting grille according to claim 1, wherein in each case two mutually adjoining quadrants (1Q, 4Q; and 2Q, 3Q) of the flow-conducting grille are designed to be mirror symmetric with respect to the zero degree radial plane (NR).

* * * * *